United States Patent [19]

Yashiki

[11] Patent Number: 4,618,559

[45] Date of Patent: Oct. 21, 1986

[54] PROCESS OF MAKING ELECTROPHOTOGRAPHIC PHOTOSENSITIVE MEMBER

[75] Inventor: Yuichi Yashiki, Yokohama, Japan

[73] Assignee: Canon Kabushiki Kaisha, Tokyo, Japan

[21] Appl. No.: 733,766

[22] Filed: May 14, 1985

[30] Foreign Application Priority Data

May 17, 1984 [JP] Japan ..... 59-97480

[51] Int. Cl.[4] ..... G03G 5/087

[52] U.S. Cl. ..... 430/127; 430/131; 430/134; 427/430.1; 427/445

[58] Field of Search ..... 430/129, 133, 131, 134, 430/127, 132, 58; 118/419, 423; 427/430 R, 445

[56] References Cited

U.S. PATENT DOCUMENTS 3,928,034 12/1975 Regensburger ..... 430/58 X 4,383,020 5/1983 Roberts et al. ..... 430/134 X

*Primary Examiner*—John D. Welsh

*Attorney, Agent, or Firm*—Fitzpatrick, Cella, Harper & Scinto

[57] ABSTRACT

In an electrophotographic photosensitive member having a charge generation layer and a charge transport layer formed by a dip-coating method, a length (H) expressed by the formula $$\int_0^{T1} V1\,dt + \int_{T1}^{T2} V(t)\,dt$$

of the charge generation layer is substantially the same as that of a film thickness changing portion of the charge transport layer (where V(t) represents an accelerating velocity from a velocity V1 to a velocity V2, and a substrate is pulled up at the velocity V1 until a time T1 has elapsed (t=T1) after the pulling up operation was started (t=0), is pulled up upon increasing the velocity from V1 to V2 until a time T2 has elapsed (t=T2) after the time T1, and thereafter is pulled up at the velocity V2 until a coating operation is completed after the time T2).

7 Claims, 6 Drawing Figures

PROCESS OF MAKING ELECTROPHOTOGRAPHIC PHOTOSENSITIVE MEMBER

BACKGROUND OF THE INVENTION

1. Field of the Invention

The present invention relates to an electrophotographic photosensitive member and, more particularly, to an electrophotographic photosensitive member having more uniformity in photosensitivity.

2. Description of the Prior Art

Electrophotographic photosensitive members have been conventionally manufactured in such a manner that a resin layer or a photosensitive layer is formed on a substrate by coating. Among several coating methods, a dip-coating method wherein a substrate is dipped in a coating solution and then withdrawn so as to coat a coating material thereon is preferably used since the coating material can be evenly coated on a substrate of any shape.

In this case, the thickness of a coating film is determined by the concentration of the coating material and the withdrawing velocity with respect to the coating material. It is known that the film thickness is increased in accordance with an increase in the coating material concentration.

However, when the withdrawing velocity is high, a sagging phenomenon occurs while the coating film is being dried and solidified. Thus, the thickness of an upper portion of the coating film is relatively small and that of a lower portion thereof is relatively large. Particularly, when the concentration of the coating solution is low and the viscosity thereof is high, since the amount of solvent used is increased, the sagging phenomenon tends to easily occur.

This tendency becomes especially pronounced in the case of coating a charge transport layer in a multifunction type electrophotographic photosensitive member having a charge generation layer and a charge transport layer. Generally, a charge transport layer is coated using a coating solution such that an electron donor material or an electron acceptor material is dissolved in a solvent together with a film forming resin. However, since the electron donor material or the electron acceptor material, particularly hydrazone compounds, styryl compounds and pyrazoline compounds, has a low solubility in a solvent, a large amount of solvent must be used. For this reason, the coating solution of the charge transport layer has a low concentration, and since the coating solution must be coated to a proper thickness, the viscosity thereof is increased. When a coating solution having a high solvent concentration is coated on a member by the dip-coating method, after the withdrawal process, since the film is dried slowly, the coating film runs downward before it solidifies. Such a phenomenon causes the film to be irregular in thickness, as shown in FIG. 1. Conventionally, in order to reduce such an irregularity in film thickness, the withdrawing velocity is initially set at a high rate, and the rate then is linearly decreased. However, it is difficult to completely eliminate such a sagging irregularity, and this sagging results in an irregular thickness of the coating film.

When the charge transport layer has an irregular film thickness, the charge potential characteristic of the film is uneven. In other words, a thick portion of the charge transport layer has a high charge potential, and a thin portion has a low charge potential. When the exposure amount required for attenuating the charge potential to a constant value (e.g., 150 V) is expressed as a photosensitivity, then because the initial charge potential is high, the attenuation width of the potential must be set to a large value, resulting in poor photosensitivity. For this reason, when the film thickness of the charge transport layer is large, the photosensitivity thereof tends to be poor.

On the other hand, since the photosensitivity also depends upon an amount of charges generated upon exposure, photosensitivity tends to be good in proportion to the increase in the film thickness of the charge transport layer. Since an irregular coating film coated on the photosensitive member causes the characteristics of the photosensitive member to be markedly unstable, a manufacturing method to produce a photosensitive member having a uniform coating film has long been desired.

SUMMARY OF THE INVENTION

It is an object of the present invention to provide an electrophotographic photosensitive member which is improved and free from the above drawbacks and, more particularly, to provide an electrophotographic photosensitive member which is free from irregularity in its sensitivity.

It is another object of the present invention to provide an electrophotographic photosensitive member which exhibits a constant sensitivity on its whole surface even when the sagging phenomenon occurs in the formation of a charge transport layer, which object is achieved by the formation of a charge generation layer with a film thickness gradient.

According to the present invention, there is provided an electrographic photosensitive member comprising a charge generation layer and a charge transport layer formed by a dip-coating method, wherein a length (H) expressed by the formula $$\int_0^{T1} V1\, dt + \int_{T1}^{T2} V(t)\, dt$$

of said charge generation layer is substantially the same as that of a film thickness changing portion of said charge transport layer (where V(t) represents an accelerating velocity from a velocity V1 to a velocity V2, and a substrate is withdrawn at the velocity V1 until a time T1 has elapsed (t=T1) after a withdrawing operation was started (t=0), is pulled up upon increasing the velocity from V1 to V2 until a time T2 has elapsed (t=T2) after the time T1, and thereafter is withdrawn at the velocity V2 until a coating operation is completed after the time T2).

It is characteristic that a thickness of a coating film increases in accordance with an increase in a withdrawal velocity. When the thickness of the charge transport layer is irregular, in order to maintain a constant photosensitivity, in the present invention, the velocity of withdrawal is initially set at a low rate, is then gradually increased with the lapse of time, and is finally set to be at a constant rate at a given time (at which the thickness of the charge transport layer becomes uniform) so that an upper portion of the charge generation layer is thinly coated and a lower portion thereof is thickly coated.

DESCRIPTION OF THE PREFERRED EMBODIMENTS

An electrophotographic photosensitive member and a method of manufacturing the same of the present invention will be described in detail with reference to the accompanying drawings.

Figure 1:
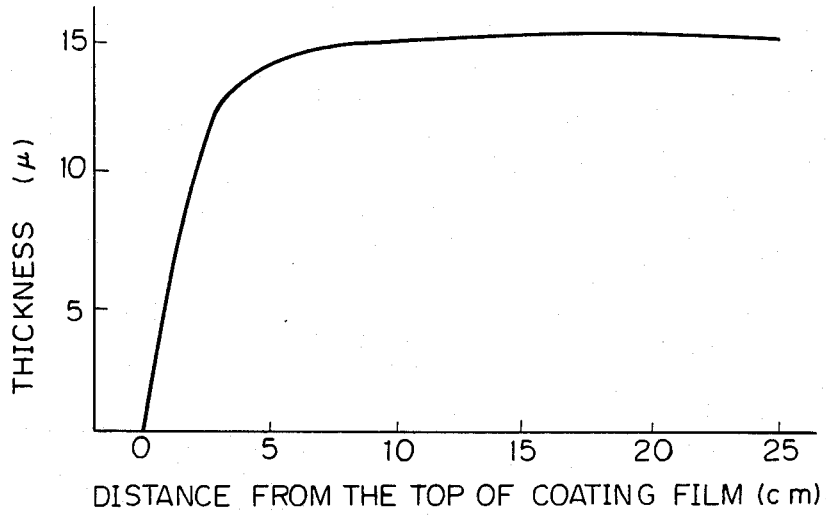
FIG. 1 is a graph for explaining an irregular film thickness of a charge transport layer.

FIG. 1 is a graph showing an irregular film thickness of a charge transport layer.

A case is shown in FIG. 1 wherein the film thickness becomes irregular in accordance with a distance from the top (end) of a coating film being pulled in a vertical posture.

Figure 2:
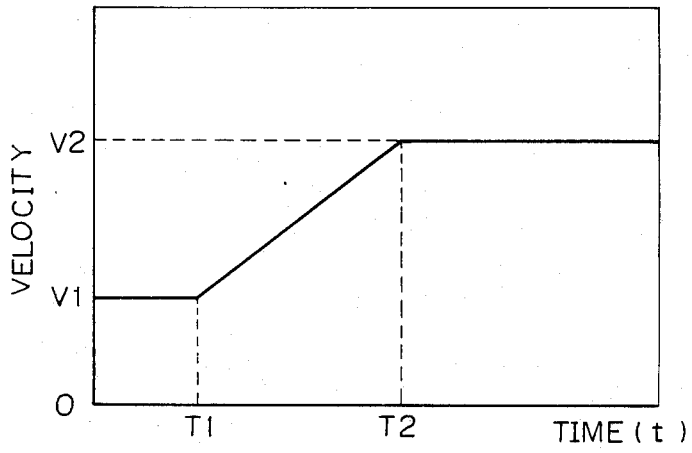
FIG. 2 is a graph showing a change in a velocity of withdrawal in a coating step of a charge generation layer.

FIG. 2 is a graph showing a change in a pulling up velocity in a coating step of a charge generating layer.

An end portion of the charge generation layer from which coating is begun must have a very thin thickness. However, in practice, since a copy image in not formed over the entire coating width, the thickness of a portion on which no image is formed need not be adjusted with high precision. In the coating step of the charge generation layer, since the velocity of withdrawal is preferably set to be high, the initial velocity of withdrawal is set to be the same velocity V1 as that immediately before it is increased. In other words, referring to FIG. 2, the velocity V1 is maintained until a time T1.

The film thickness of the charge generation layer is gradually increased so as to correspond to a portion of the charge transport layer having an irregular thickness (i.e., a portion which becomes thin due to drooping). That is, the velocity of withdrawal is gradually accelerated. This accelerating step is continued until the film forming point reaches a thickness equivalent to the charge transport layer portion having a uniform thickness. Assuming that a time corresponding to this interval is given by T2, the velocity of withdrawal is continuously increased until the time T2 as shown in FIG. 2. A velocity of withdrawal V2 is a velocity at which a predetermined thickness of the charge generation layer can be obtained.

Figure 3:
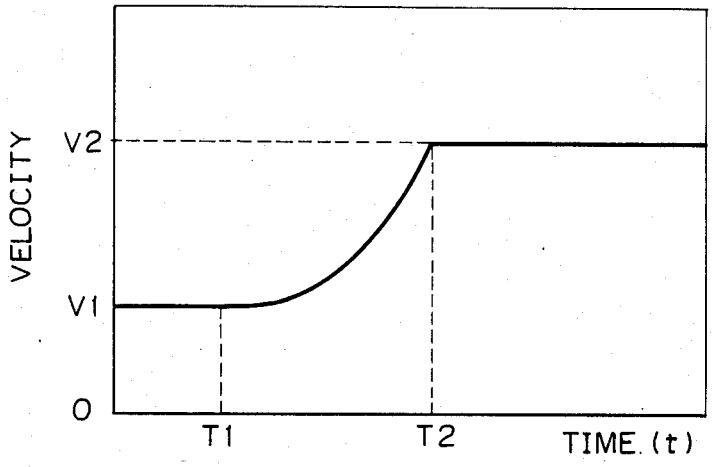
FIG. 3 is a graph showing a change in the velocity of withdrawal in a coating step of the charge generation layer.

In FIG. 2, the velocity is linearly increased but can be increased in accordance with a curve as shown in FIG. 3. In order to optimally correct an irregular film thickness of the charge transport layer, either preferable acceleration method is selected.

When the pulling up velocity is linearly increased, it is expressed as follows:

$$V(t) = \frac{V2 - V1}{T2 - T1}\, t + K1$$

(where K1 is a constant)

When the velocity of withdrawal is increased in accordance with a curve, it can be expressed as follows using, e.g., a quadratic expression:

$$V(t) = At^2 + K2$$

(where A and K2 are constants)

Assuming that a length between a coating start position of the charge transport layer and a position at which a thickness thereof becomes uniform is given by H, since a length can be obtained by integrating a velocity with respect to a time, the time T2 is calculated so as to establish the following relation:

$$H = \int_0^{T1} V1\, dt + \int_{T1}^{T2} V(t)\, dt$$

On a portion of the charge transport layer exceeding the length H, since the film thickness is constant, the charge generation layer can be pulled up or withdrawn at the constant velocity V2.

As described above, the charge generation layer is coated in the following manner. A substrate is pulled up at the velocity V1 until the time T1 has elapsed after the withdrawing operation was started, is withdrawn gradually increasing the velocity from V1 to V2 until the time T2 has elapsed, and thereafter is withdrawn at the velocity V2 until completely withdrawn. The charge transport layer is thus coated on the charge generation layer.

Figure 4:
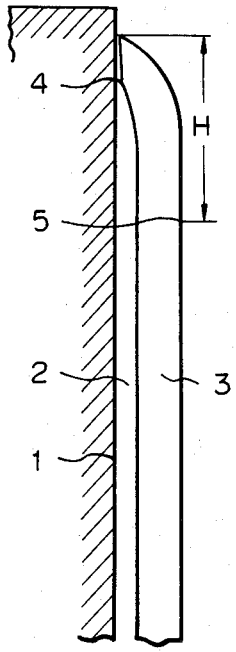
FIG. 4 is a sectional view schematically showing the thickness of layers of an electrophotographic photosensitive member manufactured by a method of the present invention.

FIG. 4 schematically shows the thicknesses of the respective layers of the electrophotographic photosensitive member formed by the above-mentioned manner. A charge generation layer 2 is coated on a substrate 1 to have a uniform thickness until a height 4. The thickness of the layer 2 is then gradually increased and reaches a predetermined value at a height 5. A charge transport layer 3 has an irregular thickness, as shown in FIG. 1.

An embodiment of the method of manufacturing the electrophotographic photosensitive member according to the present invention will be described hereinafter. In order to perform the above-mentioned method in which the pulling up velocity is changed, when the accelerating step is manually performed, instability results.

On the other hand, when a concentration of a coating solution is constant, the velocities V1 and V2 need not be changed. However, in practice, since the concentration of the coating solution is changed, the velocity of withdrawal for obtaining a desired thickness must also be changed. Therefore, in the accelerating step, the velocity must be changed.

Therefore, in order to perform the manufacturing method of the present invention, when the concentration of a coating solution is inputted, it is preferable that the velocity be calculated not manually but automatically so as to perform automatic control. It should be noted that the concentration of the coating solution may be automatically or manually measured. The concentration of the coating solution can be automatically measured using, e.g., a method for measuring viscosity of the coating solution, a method for measuring transmittance of light through the coating solution, a method for measuring specific gravity of the coating solution or the like.

Figure 5:
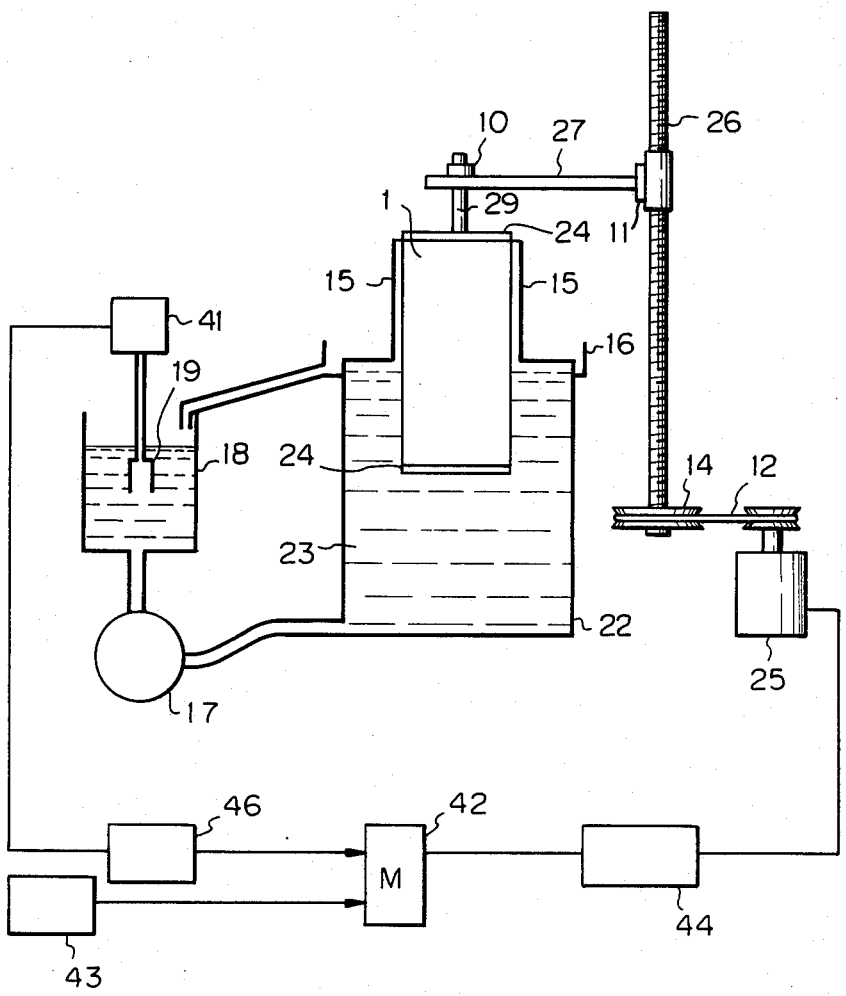
FIG. 5 is a schematic view of a coating apparatus used for the method of manufacturing the electrophotographic photosensitive member of the present invention.
Figure 6:
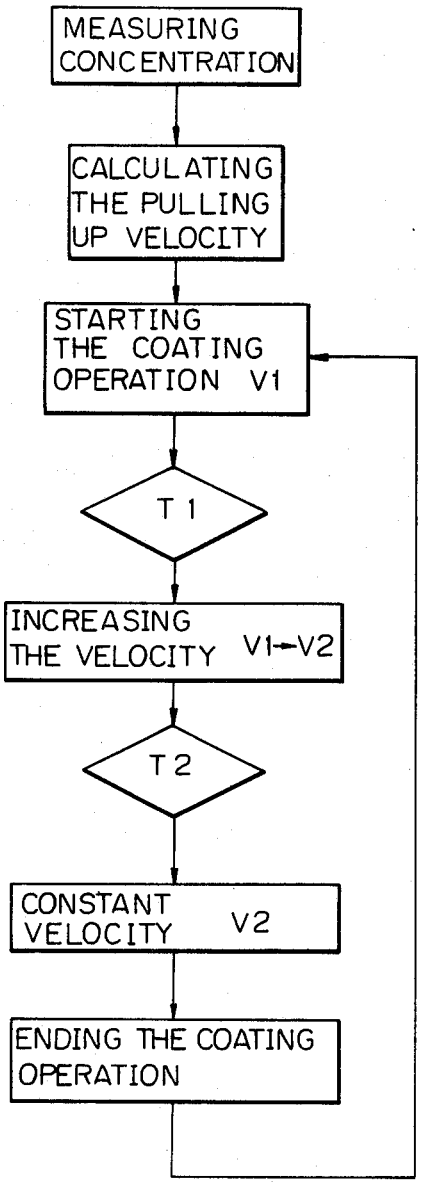
FIG. 6 is a flow chart for automatically controlling the withdrawal step of the apparatus shown in FIG. 5.

The relationship between the velocity of withdrawal and the thickness of the coating film with respect to the concentration of the coating solution must be experimentally obtained in advance. Based upon the obtained relationship, the velocity of withdrawal is calculated with respect to the concentration of the coating solution and controlled. FIG. 5 schematically shows an example of an apparatus for manufacturing the electrophotographic photosensitive member, and FIG. 6 is a flow chart showing an operation of the apparatus. Referring to FIG. 5, an embodiment is shown wherein the concentration of the coating solution is measured by a viscosity meter 41. Measurement data is calculated in a central processing unit 42 through an interface 46, thus obtaining and controlling the rate of withdrawal. The withdrawal velocity is controlled by changing a rotating speed of a motor 25 by the interface and a motor controller 44. In a coating unit, the rotation of the motor is transmitted to a screw 26 so as to move up and down a supporting member 27, thereby moving a substrate 1 in response thereto. On the other hand, a coating solution 23 overflows from an upper portion 16 of a coating tank 22 and is circulated through a coating tank 18 and a pump 17.

Note that the method of pulling up the substrate 1 and the method of circulating the coating solution 23 in FIG. 5 are proposed for optimally performing the coating step. Thus, the present invention is not limited to the above embodiment.

FIG. 6 is a flow chart for automatically controlling the pulling up velocity in the pulling up step of the substrate 1 and corresponds to an operating program of the central processing unit.

With the above apparatus, the withdrawal velocity can be automatically controlled, and the coating operation can be effectively performed with high precision. Since the film thickness is always controlled to be an optimum value, the charging potential is controlled to be uniform, thus obtaining an electrophotographic photosensitive member which does not result in irregular copy density.

In order to obtain a sufficient light absorbency, the charge generation layer preferably contains the maximum possible amount of a compound having photoconductivity and is formed to be thin, e.g., 5 microns or less, preferably, 0.01 microns to 1 micron to decrease the migration distance of the charge carriers. This is because incident light is mostly absorbed in the charge generation layer so as to produce a number of charge carriers, and the charge carriers generated must be injected to the charge transport layer without becoming deactivated by recombination or trapping.

The charge generation layer can be formed in such a manner that an azo pigment such as a monoazo pigment, a disazo pigment, a trisazo pigment or a tetrazo pigment; a phthalocyanine pigment such as metal-free phthalocyanine, copper phthalocyanine, aluminum chloride phthalocyanine, nickel phthalocyanine or lead phthalocyanine; an azulenium salt compound; a pyrylium compound or the like is dispersed in a proper binder and is coated on a substrate, or such a material is deposited thereon in a film using a vacuum deposition apparatus. The binder used when the charge generation layer is formed by coating may be selected among various insulating resins, or may be selected from organic photoconductive polymers such as poly-N-vinyl carbazole, polyvinyl anthracene, and polyvinyl pyrene. The binder preferably includes an insulating resin such as polyvinyl butyral, polyacrylate (a condensation polymer of bisphenol A and phthalic acid), polycarbonate, polyester, a phenoxy resin, polyvinyl acetate, an acrylic resin, a polyacrylamide resin, polyamide, polyvinyl pyridine, a cellulose resin, an urethane resin, an epoxy resin, casein, polyvinyl acohol, or polyvinyl pyrrolidone. A resin content of the charge generation layer is set to be 80% by weight or less, and preferably, 40% by weight or less.

A solvent for dissolving these resins depends upon the type of selected resin and is preferably selected from those which do not dissolve the charge transport layer and a subbing layer to be described later. More specifically, as an organic solvent, alcohols such as methanol, ethanol and isopropanol; ketones such as acetone, methyl ethyl ketone and cyclohexanone; amides such as N,N-dimethylformamide and N,N-dimethylacetamide; sulfoxides such as dimethyl sulfoxide; ethers such as tetrahydrofuran, dioxane, and ethylene glycol monomethyl ether; esters such as methyl acetate and ethyl acetate; aliphatic halogenated hydrocarbons such as chloroform, methylene chloride, dichloroethylene, carbon tetrachloride and trichloroethylene; or aromatic compounds such as benzene, toluene, xylene, ligroin, monochlorobenzene, and dichlorobenzene can be used.

The charge transport layer is electrically connected to the charge generation layer described above and has the function of receiving the charge carriers injected from the charge generation layer when an electric field is present and transporting these charge carriers to the surface thereof. In this case, the charge transport layer may be formed on or under the charge generationlayer. However, the charge transport layer is preferably formed on the charge generation layer.

A material for transporting the charge carriers in the charge transport layer (to be referred to as a charge transport material for brevity hereinafter) is preferably substantially nonsensitive to electromagnetic waves of wavelengths to which the charge generation layer is sensitive. Note that "electromagnetic waves" here include "light rays" in a broad sense including $\gamma$-rays, x-rays, ultraviolet rays, visible light, near infrared rays, infrared rays, far infrared rays and the like.

The charge transport material includes an electron transport material and a hole transport material. The electron transport material includes an electron acceptor material such as chloranil, bromoanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, or 2,4,8-trinitrothioxanthone, or polymers thereof.

The following compounds are known as the hole transport materials, i.e., pyrene, N-ethylcarbazole, N-isopropylcarbazole, N-methyl-N-phenylhydrazino-3-methylidene-9-ethyl-carbazole, N,N-diphenylhydrazino-3-methylidene-9-ethyl-carbazole, N,N-diphenylhydrazino-3-methyl-idene-10-ethyl-phenothiazine, N,N-diphenyl-hydrazino-3-methylidene-10-ethylphenoxazine, hydrazones such as p-diethylaminobenzaldehyde-N,N-diphenylhydrazone, p-diethylaminobenzaldehyde-N-$\alpha$-naphthyl-N-phenylhydrazone, p-pyrrolidinobenzaldehyde-N,N-diphenylhydrazone, 1,3,3-trimethylindolenine-$\omega$-aldehyde-N,N-diphenylhydrazone, or p-diethylbenzaldehyde-3-methylbenzthiazolinone-2-hydrazone; pyrazolines such as 2,5-bis(p-diethylaminophenyl)-1,3,4-oxadiazole, 1-phenyl-3-(p-diethylaminostyryl)-5-(p-diethylaminophenyl)pyrazoline, 1-[quinolyl(2)]-3-(p-diethylaminostyryl)-5-(p-diethyl-aminophenyl)pyrazoline, 1-[pyridyl(2)]-3-(p-diethylaminostyryl)-5-(p-diethyl-aminophenyl)pyrazoline, 1-[6-methoxy-pyridyl(2)]-3-(p-diethylaminostyryl)-5-(p-diethylaminophenyl)-pyrazoline, 1-[pyridyl(3)]-3-(p-diethylaminostyryl)-5-(p-diethyl-aminophenyl)pyrazoline, 1-[lepidyl(2)]-3-(p-diethyl-aminostyryl)-5(p-diethylaminophenyl)pyrazoline, 1-[pyridyl(2)]-3-(p-diethylaminophenyl)pyrazoline, 1-[pyridyl(2)]-3-(p-diethylaminostyryl)-4-methyl-5-(p-diethylaminophenyl)pyrazoline, 1-[pyridyl(2)]-3-(α-methyl-p-diethylamino-styryl)-5-(p-diethylaminophenyl)pyrazoline, 1-phenyl-3-(p-diethylaminostyryl)-4-methyl-5-(p-diethylaminophenyl)pyrazoline, 1-phenyl-3-(α-benzyl-p-diethylaminostyryl)-5-(p-diethylaminophenyl)pyrazoline, and spiropyrazoline; oxazole compounds such as 2-(p-diethylaminostyryl)-6-diethylaminobenzoxazole, and 2-(p-diethylaminophenyl)-4-(p-dimethylaminophenyl)-5-(2-chlorophenyl)oxazole; thiazole compounds such as 2-(p-diethylaminostyrl)-6-diethylaminobenzothiazole; triarylmethane compounds such as bis(4-diethylamino-2-methylphenyl)-phenylmethane; polyarylalkanes such as 1,1-bis(4-N,N-diethylamino-2-methylphenyl)hepthane, and 1,1,2,2-tetrakis (4-N,N-dimethylamino-2-methylphenyl)ethane; stilbene compounds such as 4-N,N-dimethylaminostilbene, 4-N,N-dimethylaminostilbene, and 4-N,N-diphenylaminostilbene; triphenylamine; poly-N-vinylcarbazole; polyvinyl pyrene; polyvinyl anthracene; polyvinyl-acridine; poly-9-vinylphenylanthracene; a pyrene-form-aldehyde resin; an ethylcarbazolformaldehyde resin and the like.

In addition to these organic charge transport materials, inorganic materials such as selenium, selenium-tellurium amorphous silicon, cadmium sulfide and the like can be used.

One or a combination of more than one of these charge transport materials can be used.

When the charge transport material does not have a film forming property, it can be formed into a film by use of a proper binder. For example, the following resins can be used as the binder, i.e., an insulating resin such as an acrylic resin, polyacrylate, polyester, polycarbonate, polystyrene, an acrylonitrile-styrene copolymer, an acrylonitrile-butadiene copolymer, polyvinyl butyral, polyvinyl formal, polysulfone, polyacrylamide, polyamide, or chlorinated rubber; or an organic photoconductive polymer such as poly-N-vinylcarbazole, polyvinylanthracene, or polyvinylpyrene.

Since the charge transport layer has a limited capacity for transporting the charge carriers, a thickness thereof cannot be increased to a larger value than a necessary one. The thickness of the charge transport layer generally falls within the range between 5 microns and 30 microns, and preferably falls within the range between 8 microns and 20 microns. When the charge transport layer is formed by coating, the above coating method can be used.

The photosensitive layer having a laminated structure of the charge generation layer and the charge transport layer is provided on a conductive substrate having a conductive layer. As the substrate having a conductive layer, the substrate itself having conductivity, for example, a cylinder member made of a metal or alloy such as aluminum, an aluminum alloy, copper, zinc or stainless steel is suitable.

A subbing layer having a barrier function and an adhesive function may be provided between the conductive substrate and the photosensitive layer. The subbing layer can be formed from a material such as casein, polyvinyl alcohol, nitrocellulose, an ethylene-acrylic acid copolymer, polyamide (such as nylon 6, nylon 66, nylon 610, copolymeric nylon, or alkoxymethylated nylon), polyurethane, gelatine, aluminum oxide or the like.

At thickness of the subbing layer may fall within the range between 0.1 microns and 5 microns, and preferably between 0.5 microns and 3 microns.

The present invention will be described by way of its examples hereinafter.

EXAMPLE 1

An aluminum cylinder having a diameter of 60 mm and a length of 260 mm was prepared as a substrate. As a coating solution for a subbing layer, 2 parts by weight of a polyamide resin (tradename: "Amilan CM 8000" availabel from TORAY INDUSTRIES, INC.) and 2 parts by weight of a nylon 8 resin (tradename: "EF30T" available from Teikoku Kagaku, Inc.) were dissolved in 50 parts by weight of methanol and 40 parts by weight of n-butanol. In accordance with a dip-coating method, the substrate was withdrawn at a constant velocity of 200 mm/min, thus forming a subbing layer of 0.5μ thickness.

A coating solution of the charge generation layer was prepared by dispersing 10 parts by weight of a disazo pigment having the following structural formula:

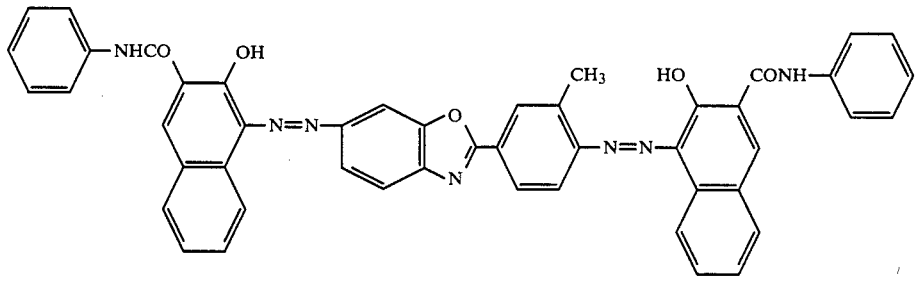

6 parts by weight of a cellulose acetate butyrate resin (tradename: "CAB-381" available from Eastman Chemical Products, Inc.) and 60 parts by weight of cyclohezanone in a sand milling device using 1-mm diameter glass beads for 20 hours. 100 parts by weight of methyl ethyl ketone were added to the resultant dispersion, and the resultant mixture was charged in the apparatus shown in FIG. 5.

In accordance with the precalculated relation, variables were set such that T1=3 (sec), T2=36 (sec), V1=1.5 (mm/sec) and V2=3 (mm/sec). In addition, the velocity of withdrawal linearly increased from V1 to V2 as shown in FIG. 2. When V1=1.5 (mm/sec), a thickness of the charge generation layer was 0.07μ, and when V2=3 (mm/sec), it was 0.11μ.

In the coating step, the velocity of withdrawal was 1.5 mm/sec until 3 seconds elapsed from the beginning (0 second), was increased in accordance with the equation V(t)=0.0455t+1.36 for the period of 3 to 36 seconds, and was kept at a constant velocity of 3 mm/sec after 36 seconds elapsed. Such coating method provided a charge generation layer with a thickness gradient of from 0.07μ to 0.11μ.

A coating solution of the charge transport layer was prepared in such a manner that 10 parts by weight of a hydrazone compound having the following structural formula:

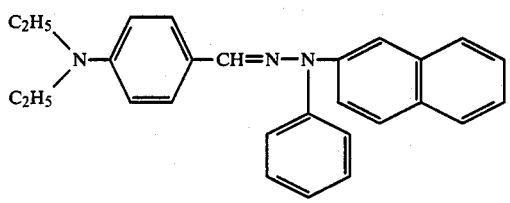

and 15 parts by weight of a styrene-methyl methacrylate copolymer resin (tradename: "MS 200" available from Shinnittetsu Kagaku Co., Lts.) were dissolved in 80 parts by weight of toluene, and the resultant mixture was charged in the apparatus shown in FIG. 5.

In accordance with the dip-coating method, the resultant structure was dipped in the coating solution for the charge transport layer and was pulled up at a velocity of 2 mm/sec, thus forming a charge transport layer of 15μ thickness on the charge generation layer. A height (H) from a coating start position to a portion at which the film thickness became uniform was 80 mm, and the resultant structure had a film thickness distribution as shown in FIG. 1.

The electrophotographic photosensitive member thus prepared was mounted in the copying machine to obtain a copy image. When the copy image was observed, the image density was uniform.

COMPARATIVE EXAMPLE 1

Without using the manufacturing method of the present invention, when the charge generation layer was formed by coating, the substrate was withdrawn at a constant velocity of 3 mm/sec, thus manufacturing an electrophotographic photosensitive member having the layer with a uniform thickness. When a copy image obtained by using this photosensitive member was observed, its image density was degraded in the image portion corresponding to a thinner portion of the charge transport layer.

What is claimed is:

1. In a process for preparing an electrophotographic photosensitive member by forming a charge generation layer on a substrate by dip-coating and forming a charge transport layer by dip-coating, wherein the charge transport layer forms a predetermined irregular end film portion of length H, which irregular film portion impairs the photosensitivity of the member, the improvement which comprises:

(a) controlling the thickness of the corresponding end film portion of the charge-generation layer over the length H by varying the withdrawal rate of the substrate during the dip-coating thereof in accordance with the formula $$H = \int_0^{T1} V1\,dt + \int_{T1}^{T2} V(t)\,dt$$

wherein T1 is the total time which elapses from the start of the dip-coating of the charge generation layer until the portion of the charge generation film is reached which corresponds to one end of the length H; V1 is the withdrawal rate of the substrate which rate is maintained for the time T1; V(t) is the rate of acceleration of the substrate from the first rate, V1 to a final higher rate, V2; T2 is the elapsed time required to withdraw the substrate over the length H as the withdrawal rate increases from V1 to V2; and (b) thereafter, completing the dip-coating of the charge generation layer at the rate, V2; whereby the total thickness of the charge generation layer and the charge transport layer over the length H is sufficient to improve the photosensitivity of the member.

2. An electrophotographic photosensitive member according to claim 1, wherein in the formula, $V(t)=t(V2-v1)/(T2=T1)+K1$ (where K1 is a constant).

3. An electrophotographic photosensitive member according to claim 1, wherein in the formula, $V(t)=At^2+K2$ (where A and K2 are constants).

4. An electrophotographic photosensitive member according to claim 1, wherein said charge transport layer is a coating film formed by withdrawing the substrate at a constant velocity.

5. An electrophotographic photosensitive member according to claim 4, wherein said charge transport layer is a layer containing a binder and at least one charge transport material selected from the group consisting of hydrazone compounds, stilbene compounds and pyrazoline compounds.

6. An electrophotographic photosensitive member according to claim 1, wherein said charge transport layer is coated on said charge generation layer.

7. The electrophotographic photosensitive member of claims 2, 3, 4, 5, 6, or 1.

* * * * *

UNITED STATES PATENT AND TRADEMARK OFFICE

CERTIFICATE OF CORRECTION

PATENT NO. : 4,618,559

DATED : October 21, 1986

INVENTOR(S) : YUICHI YASHIKI

It is certified that error appears in the above-identified patent and that said Letters Patent is hereby corrected as shown below:

COLUMN 7

Lines 11-12, "phenyl)pyrazo-/line, 1-[pyridyl(2)]-3-(p-diethylamino" should be deleted.

COLUMN 10

Line 39, "t(V2-v1)" should read --t(V2-V1)--.

Signed and Sealed this

Third Day of March, 1987

*Attest:*

*Attesting Officer*

DONALD J. QUIGG

*Commissioner of Patents and Trademarks*